US005770158A

United States Patent [19]

Eischen et al.

[11] Patent Number: 5,770,158

[45] Date of Patent: Jun. 23, 1998

[54] CAPILLARY SYRINGE

[75] Inventors: Kathleen A. Eischen, St. Paul, Minn.; James W. Kenney, Broomall, Pa.

[73] Assignee: Diametrics Medical, Inc., Roseville, Minn.

[21] Appl. No.: 661,310

[22] Filed: Jun. 13, 1996

[51] Int. Cl.[6] ..... B01L 3/02

[52] U.S. Cl. ..... 422/100; 422/99; 422/103; 422/104; 436/180; 73/864.13; 73/864.16; 73/864.18

[58] Field of Search ..... 422/99, 100, 103, 422/104; 436/180; 73/864.16, 864.18, 864.13, 864.01, 864.02

[56] References Cited

U.S. PATENT DOCUMENTS

| | | | |
|---|---|---|---|
| D. 262,319 | 12/1981 | Kenney | D24/55 |
| 3,641,823 | 2/1972 | Harris, Sr. et al. | 422/100 X |
| 3,834,240 | 9/1974 | Kenney | 73/425.6 |
| 3,834,590 | 9/1974 | Robinson et al. | 222/148 |
| 3,963,061 | 6/1976 | Kenney | 141/21 |
| 4,063,662 | 12/1977 | Drummond et al. | 222/31 |
| 4,250,755 | 2/1981 | Kenney | 73/425.6 |
| 4,347,215 | 8/1982 | Sisti et al. | 422/63 |
| 4,461,328 | 7/1984 | Kenney | 141/67 |
| 4,624,147 | 11/1986 | Kenney | 73/864.15 |
| 4,662,545 | 5/1987 | Kenney | 222/386 |
| 4,873,059 | 10/1989 | Kido et al. | 422/100 |
| 4,909,991 | 3/1990 | Oshikubo | 422/100 |
| 4,933,148 | 6/1990 | Perlman | 422/100 |
| 5,059,398 | 10/1991 | Kenney | 422/100 |
| 5,063,025 | 11/1991 | Ito | 422/100 |
| 5,090,255 | 2/1992 | Kenney | 73/1 R |
| 5,104,625 | 4/1992 | Kenney | 422/100 |
| 5,173,266 | 12/1992 | Kenney | 422/100 |
| 5,214,968 | 6/1993 | Kenney | 73/864.15 |
| 5,217,693 | 6/1993 | Anderson et al. | 422/100 |
| 5,294,405 | 3/1994 | Kenney | 422/103 |
| 5,364,596 | 11/1994 | Magnussen, Jr. et al. | 422/100 |
| 5,440,940 | 8/1995 | Huse et al. | 210/198.2 |
| 5,454,268 | 10/1995 | Kim | 73/864.01 |
| 5,460,782 | 10/1995 | Coleman et al. | 422/100 |
| 5,531,131 | 7/1996 | Sabloewski | 73/864.18 |

*Primary Examiner*—Harold Y. Pyon
*Attorney, Agent, or Firm*—Haugen and Nikolai, P.A.

[57] ABSTRACT

A disposable, vented capillary draw device is described that is also capable of use for the syringe pressurized dispensing of liquid benignly drawn. The system includes a vented capillary collection tube for drawing liquid samples by capillary rise in a bubble-free manner. A reversible, positive vent shut-off is provided to help contain the drawn material in the capillary. A reciprocating, loose fitting, syringe plunger arrangement is also provided attached to and operable in the capillary tube. Initial axial displacement of the plunger in the capillary toward the open end is used to initially operate the vent seal or positive vent shut-off device to close the vent and, upon further advancement of the plunger, the plunger forces the liquid material back out of the draw tube.

18 Claims, 6 Drawing Sheets

CAPILLARY SYRINGE

BACKGROUND OF THE INVENTION

I. Field of the Invention

The present invention is directed generally to the handling of small volumes of liquid, such as fluid samples or the like and, more specifically, to the field of disposable capillary syringe devices for drawing selected volumes of liquid at one location and transferring and discharging amounts of the liquid at other locations. The devices are particularly suitable for the transfer of blood samples from a patient to a diagnostic or other analytical device.

II. Related Art

Devices including a class of capillary pipette devices which utilize the capillary rise of the liquid in a capillary tube have been used to draw and transfer liquids, including samples of blood from patients to a variety of analytical instruments, test tubes or other useful devices. Capillary tubes are particularly useful with drawing material from a drop of blood classically produced by a pin stick in the finger, heel, toe, scalp or other location because capillary tubes readily draw up liquid material without entraining air bubbles enabling easy, accurate sample collection.

One prior device depicted in U.S. Pat. No. 5,059,398 to Kenney, a co-inventor in the present application, includes an open-ended capillary tube and a hydrophobic barrier member positioned in the capillary that allows the passage of air as the tube fills but which prevents or limits the passage of liquid. A piston is provided to push the barrier member toward the filling end to discharge the liquid from the filling end in accordance with desired use of the liquid sample.

While such devices have been successful, particularly for low pressure sample discharge applications, the discharge pressure usable with such devices is quite limited and a gas-permeable barrier does not provide a positive closure. There remains a need to provide a transfer device that combines a bubble-free capillary draw filling action with a syringe-like dispensing system that enables generation of sufficient pressure for use in applications where the sample must be injected under pressure. This occurs, for example, where the sample must displace a calibrant medium or the like. In addition, the ability to open and close the filling vent port in a positive, independent manner is also sought.

Accordingly, it is a primary object of the present invention to provide a disposable, vented capillary collection device capable of syringe-like pressurized discharge.

Another object of the present invention is to provide a disposable, vented capillary collection device capable of syringe-like pressurized discharge wherein the discharge pressure is sufficient to dislodge a gel calibrant material from an electro-chemical testing device.

Yet another object of the present invention is to provide a vented capillary collection device having a positive vent shut-off system.

Yet still another object of the present invention is to provide a disposable, vented capillary collection device capable of syringe-like pressurized discharge in which the syringe system is provided with a safety plunger system to prevent accidental sample discharge.

A further object of the invention is to provide a capillary collection device for blood samples obtained from finger sticks or the like for transferring the samples for injection into a device having a matching Luer fitting or the like.

Other objects and advantages will become apparent upon gaining a familiarity with the descriptive material of the specification, together with the appended claims.

SUMMARY OF THE INVENTION

The present invention provides a disposable, vented capillary draw device and is also capable of use for the syringe-like pressurized dispensing of liquid benignly drawn. The system includes a vented capillary collection tube for drawing liquid samples by capillary rise in a bubble-free manner. A reversible, positive vent shut-off is provided to help contain the drawn material in the capillary. A reciprocating, loose fitting, syringe plunger arrangement is also provided attached to and operable in the capillary tube. Initial axial displacement of the plunger in the capillary toward the open end is used to initially operate the vent seal or positive vent shut-off device to close the vent and, upon further advancement of the plunger, the plunger forces the liquid material back out of the draw tube. Mechanical stops are provided for the syringe-plunger mechanism in the draw and in the fill and vent seal positions and a safety interlock is provided with respect to the capillary discharge portion of the operation of the plunger to prevent accidental discharge of captured liquid. The open or fill/discharge end of the capillary tube may be conveniently shaped as desired to accommodate or be accommodated in a specific filling receptacle device such as a Luer fitting attached to an analytical device if desired.

One embodiment of the invention includes the length of capillary-sized tubing which may be any size within the capillary range, normally one millimeter or less ID, but sufficiently fine so that the capillary attraction of the liquid into the tube is significant. The tube may be made of glass, but is preferably a clear plastic material. A loose-fitting plunger device is fitted into one end of the tube and the other end is open to receive or draw liquid material or to dispense or discharge material. The tube is carried in a frame system that includes a finger grip tube carrying portion and a plunger carrying and operating portion attached to the protruding end of the plunger that extends beyond the end of the capillary tube. The plunger actuating handle portion is operable to reciprocally move the plunger along the interior of the capillary tube. The insertion interface or juncture between the plunger and the tube is sufficiently loose to allow air to escape readily during filling. The forward or distal tip of the plunger is provided with a segment of reduced diameter that is fitted over a resilient O-ring or other such device. The tip of the plunger is further provided with a vent opening in the form of a short recess or keyway that extends to the distal end of the tip and ends a distance from the proximal end of the segment of reduced diameter. Thus, with the O-ring positioned over the keyway, a vent is formed between the plunger and the O-ring in this manner. The O-ring provides a seal against the inner capillary wall.

The handle portion includes a directional tooth and notch system that initially positions the handle in the fully outward draw or fill position with the handle teeth engaged in an outer notch and allows the handle to be depressed to click the plunger forward a short distance to cause the teeth to engage a second notch to close the air vent by advancing the plunger into the O-ring beyond the proximal end of the keyway vent. Further advancement of the plunger is prevented by a directional stop on the capillary support frame. The directional stop may be overcome by rotating the plunger-activating handle relative to the tube-carrying frame. This enables further axial displacement of the handle to cause the plunger to exhaust all of the liquid from the capillary end or whatever pressure is necessary as the O-ring provides a positive fluid seal among the ring, plunger and tube enabling pressurized discharge.

The system is relatively simple in construction and readily adaptable to disposable sampling devices, particularly those used to collect micro-samples of blood or other bodily fluids for electro-chemical or other type of analysis. The open tip of the capillary may be designed to be accommodated in a specialty fitting of an analytical instrument, such as a cartridge used for rapid analysis of blood gas or other constituents. Transfer is thus accurate and safe with designed sample point seating in the form of compatible fittings.

The typical sample size is between 50 and 200 μL. One capillary device in accordance with the invention had a 125 μL, plus or minus 4 percent capillary fill. It is also preferred that the capillary portion of the device be transparent so that the proper filling and operation can be observed.

BRIEF DESCRIPTION OF THE DRAWINGS

In the drawings wherein like numerals designate like parts throughout the same.

DETAILED DESCRIPTION

Figure 1:
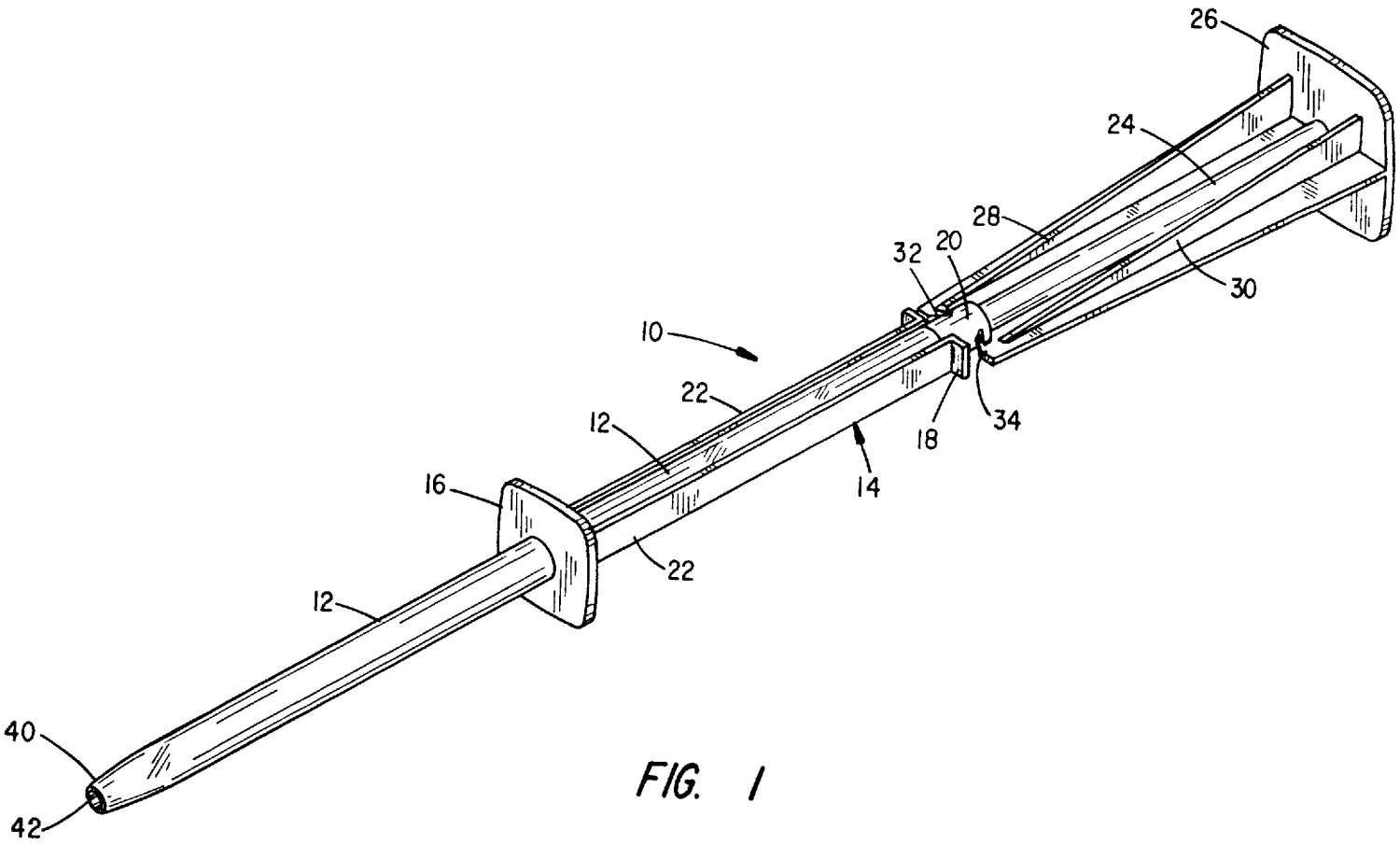
FIG. 1 is an enlarged perspective view of a vented capillary collection device in accordance with the invention.

FIG. 1 depicts an enlarged perspective view of a disposable, vented capillary collection device having a syringe-like pressurized discharge system. The device is shown generally at 10 and includes a capillary collection or draw tube 12 carried in the frame 14 that includes a finger grip 16, a pair of directional stop tabs 18 and a notched top hub portion 20. The directional stop members 18 and sets of spaced hub notches 21, 23 (FIGS. 3*a*–3*c*) are aligned directionally. Hub 20 is connected with the finger grip 16 by a pair of side members 22 that allow a portion of the tube 12 to remain observable. The handle portion 23 includes a plunger 24 which has a fixed end connected to thumb or push plate 26 and a free end extending into the tube 12 through a central bore in the hub 20, as better shown in FIGS. 2*a*–4. Resilient tooth carrying shaped members 28 and 30 flank the plunger 24 and contain inward directed teeth as at 32 and 34 shown received in an upper notches 21 of 20. The inward directed resilience of the members 28 and 30 maintain teeth 32 and 34 in notches 21. This represents the fully extended open vent handle position set for receiving or drawing a sample. The capillary tube may have any type of a shaped distal end shown contoured at 40 and having a receiving/discharging opening 42.

Figure 2A:
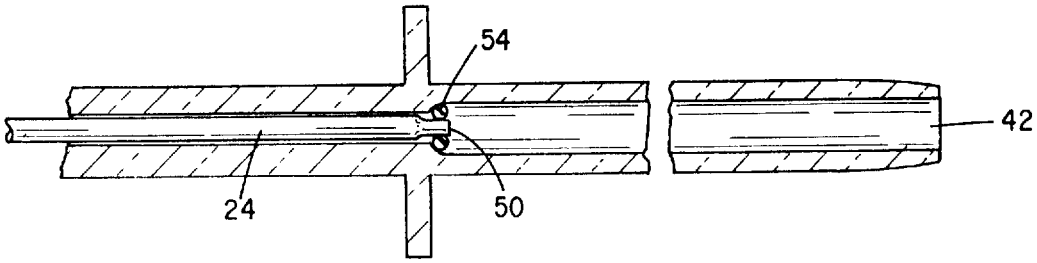
FIGS. 2*a*–2*d* are fragmentary schematic illustrations illustrating the operation of the vent and plunger system of the invention.
Figure 4:
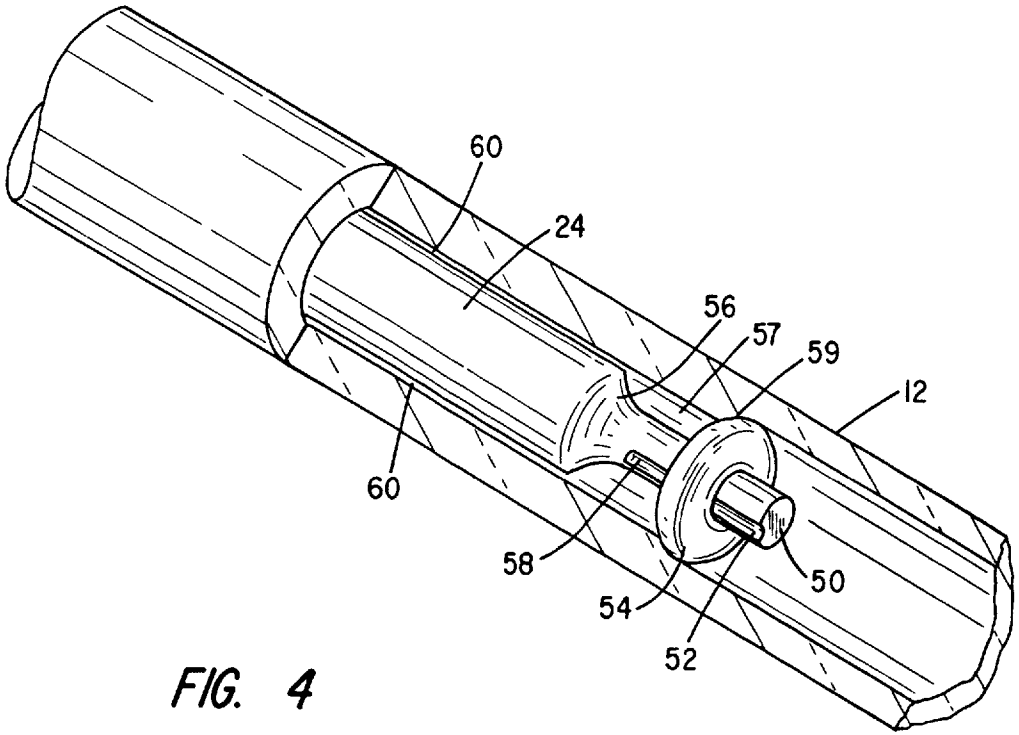
FIG. 4 is a greatly enlarged fragmentary view partially in section of the capillary seal system of the invention.

As seen better in FIGS. 2*a*–2*d* and 4, the plunger 24 is provided with a necked down distal segment of reduced diameter as shown at 50 which is provided with a longitudinal recess that resembles a keyway at 52 along part of the length of reduced diameter. An O-ring 54 is provided of a dimension for sealing against the transition or contoured juncture 56 between the reduced diameter portion of the plunger 50 and the inside of the capillary tube 12. The capillary 12 is also provided with a length of reduced diameter 57 and a transition shoulder 59 beyond which the O-ring cannot travel. As illustrated in FIGS. 4 and 2*a*, with the plunger withdrawn in the fill position, the O-ring is prevented from being withdrawn beyond the shoulder 59 thereby assuring that the recess 52 extends beyond the O-ring at 58 thereby providing a continuous vent passage allowing air displaced by a sample drawn through the opening 42 to escape through the opening 52 and between the interior wall of the capillary 12 and the loose fitting plunger 24 at 60. This allows air to escape from the system as the sample is drawn.

Figure 2B:
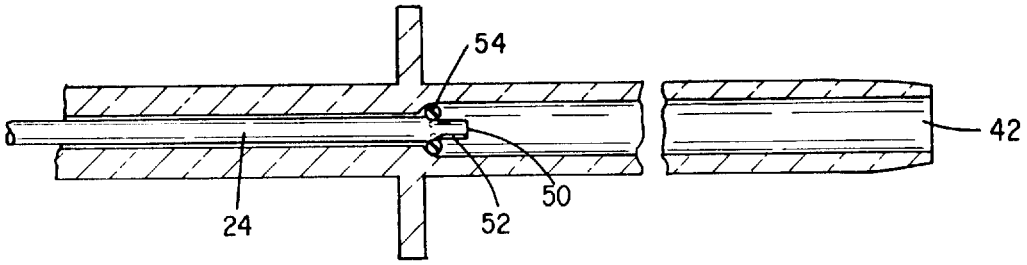
Figure 2C:
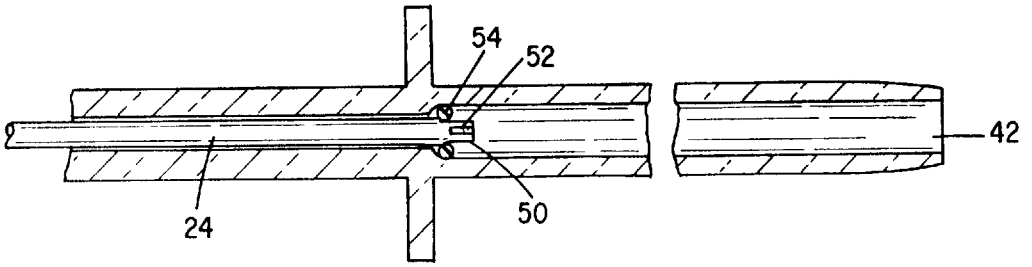
Figure 2D:
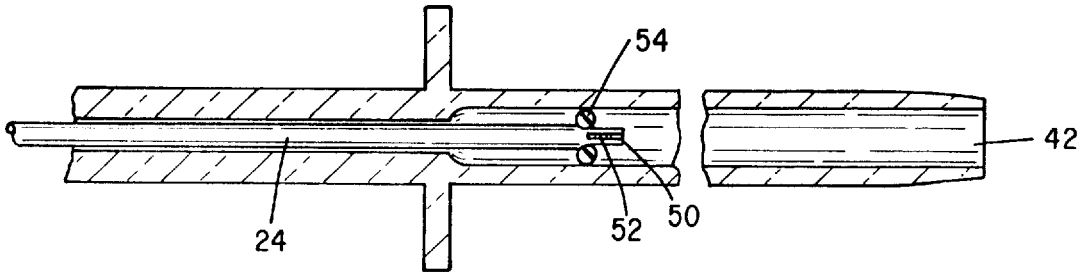
Figure 3A:
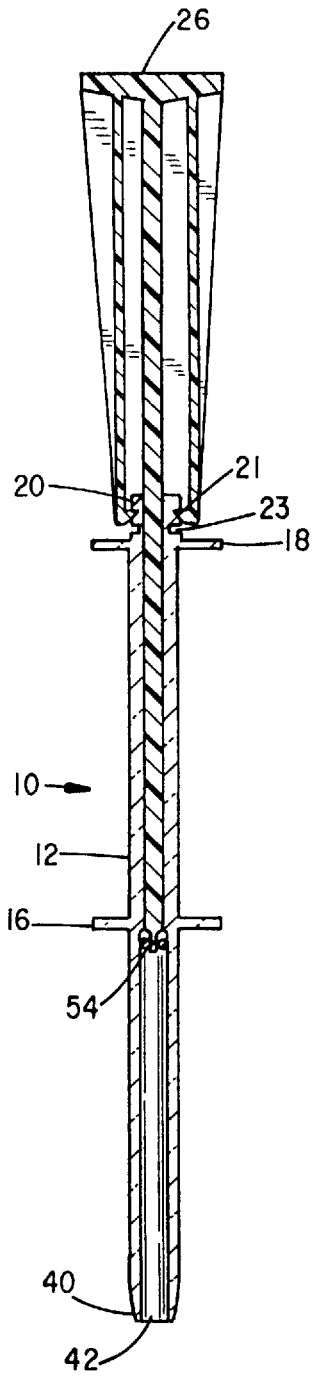
FIGS. 3*a*–3*c* are fragmentary perspective schematic views similar to FIGS. 2*a*, 2*b* and 2*d*.
Figure 3B:
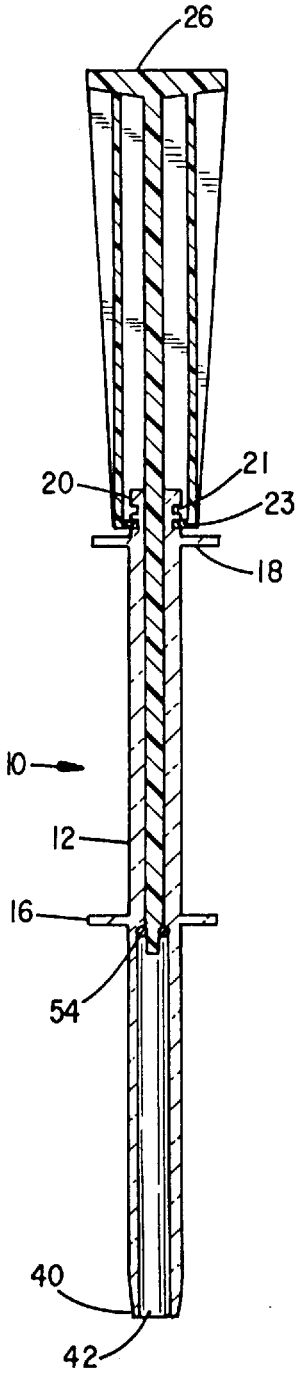
Figure 3C:
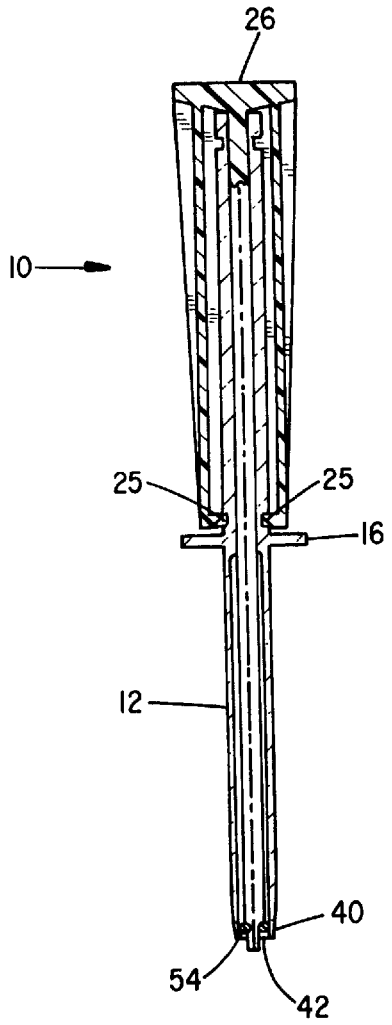

As depicted in FIGS. 2*b* and 3*b*, when the handle system is moved or clicked from upper notches 21 into lower notches 23, the O-ring becomes seated in the contour 56 of the transition between the fully reduced diameter segments of the plunger 24 proximal the keyway 52 thereby positively sealing off the escape route of air through the keyway 52. In this position, however, the plunger can be thrust no further because of directional stop members 18 and, as shown in FIG. 2*c*, must be rotated so that the members 28 and 30 are no longer aligned with the directional stop members 18. In this manner and as shown in FIGS. 2*d* and 3*c*, the handle can be depressed and the plunger and O-ring combination utilized to expel any amount of sample. Unlike with typical capillary tubes, because the plunger can be extended the full length of the capillary, all the sample in the capillary tube can be discharged. The rotation requirement provides an added safety feature preventing the accidental discharge of blood or other material from the capillary tube.

In operation, the initial or drawing position is as shown in FIG. 1 or FIG. 3*a*. In this position the plunger is fully withdrawn with teeth 32 and 34 in upper notches 21 and the vent 52 open to vent the air in the capillary 12 as the sample is drawn. Once the sample is received, the handle is moved to the position 2b or 3b in which the vent is positively shut off, but in which the sample is still fully held within the capillary tube 12. At the desired point of discharge, the handle 26 is rotated 90 degrees and thereafter the plunger may be fully depressed to discharge the sample as desired.

The shape of the end of the capillary tube 40 may be any desired or specialty shape compatible or specifically designed for use with any particular sample input receptacle. Thus, in many cases, a tight seal between the discharge nozzle and a fitting on the device into which a sample is discharged may be desirable to assure proper loading of the sample for testing. The tube 12 is preferably of clear plastic or glass so that the sample is fully visible as drawn and can be observed throughout the procedure. In addition, the capillary tube 12 may be graduated if the amount to be discharged needs to be a measured fraction of the total draw. As seen in FIG. 3*c*, a further set of notches may be provided adjacent the finger grip 16 to secure the system with the plunger in the fully advanced position. In this position, of course, the sample has been fully expelled or discharged.

One such capillary device had a capacity of 125 μL, plus or minus 4 percent in the capillary fill and utilized a capillary tube having a clear plastic barrel with an ID of 2.4 mm and an opaque plunger that could readily be viewed through the clear plastic barrel. Of course, the tolerances regarding accuracy of measure can be anything desired presently capable of manufacture and ±1 percent is clearly possible in most cases.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A disposable capillary syringe device comprising:

(a) capillary tube having a tube wall and a hollow interior for withdrawing liquid by capillary draw;

(b) generally cylindrical plunger means reciprocally operable in said capillary tube for operating with a resilient pressurizable sealing means and discharging said liquid from said capillary tube under pressure;

(c) handle means connected to said plunger means for operating said plunger means in said capillary tube means; and (d) resilient pressurizable sealing means in said capillary tube sealable against said tube wall and having a central opening for enabling said capillary tube means to fill by capillary draw, said central opening in said resilient sealing means being resiliently sealed by advancing said plunger means into said opening in said sealing means.

2. The device of claim 1 wherein said capillary has a draw/discharge end shaped to fit a specific inlet to a sample processing device.

3. The device of claim 1 wherein said plunger can be caused to travel along the length of said capillary to dispel the entire contents thereof.

4. The device of claim 1 further comprising safety stop means for preventing unintentional depression of said plunger handle and discharge of liquid from the capillary.

5. The device of claim 1 wherein said safety stop means comprises at least one directional stop means.

6. The device of claim 1 further comprising handle engaging means for positioning said plunger in said tube means.

7. The device of claim 6 wherein said handle engaging means further comprises a notch and tooth system.

8. The device of claim 1 wherein said resilient pressurizable sealing means in an O-ring.

9. The device of claim 8 wherein said O-ring provides a movable pressurizable liquid seal with said capillary tube wall and with said plunger.

10. The device of claim 9 wherein said sealing means is adjustable along said capillary tube by axial movement of said plunger to accomplish pressurized discharge.

11. The device of claim 1 wherein said sealing means is adjustable along said capillary tube by axial movement of said plunger to accomplish pressurized discharge.

12. The device of claim 11 wherein said sealing means is an O-ring.

13. The device of claim 12 wherein said O-ring provides the only seal between said capillary tube and said plunger.

14. The device of claim 1 wherein said plunger means further comprises a distal end segment of reduced diameter and having longitudinal recess extending from the distal end part way along said plunger means wherein the position of said resilient pressurizable sealing means is adjustable along said plunger means such that when said sealing means is localed in the vicinity of said recess, said recess provides an opening between said sealing means and said plunger and wherein said sealing means is moved beyond said recess said opening is sealed.

15. The device of claim 14 further comprising handle engaging means for positioning said plunger in said tube means.

16. The device of claim 15 wherein said handle engaging means further comprises a notch and tooth system.

17. A method of providing a liquid sample for testing, comprising the steps of:

(a) preventing a capillary syringe means having (i) a tube wall and a hollow interior for withdrawing liquid by capillary action;

(ii) generally cylindrical plunger means reciprocally operable in said capillary tube for operating with a resilient pressurizable sealing means and discharging said liquid from said capillary tube under pressure;

(iii) handle means connected to said plunger means for operating said plunger means in said capillary tube means; and (iv) resilient pressurizable sealing means in said capillary tube sealable against said tube wall and having a central opening for enabling said capillary tube means to fill by capillary action, said central opening in said resilient sealing means being sealed by advancing said plunger means into said opening in said resilient sealing means;

(b) drawing a volume of liquid to be tested into said capillary tube by capillary action with said opening open;

(c) closing the opening by operation of said plunger;

(d) transferring said sample to a desired point of discharge; and (e) discharging the liquid from said capillary syringe by operation of said plunger with said opening sealed.

18. The method of claim 17 further comprising the step of releasing a safety stop prior to step (e).

* * * * *